United States Patent [19]

Mummert

[11] Patent Number: 4,561,343

[45] Date of Patent: Dec. 31, 1985

[54] SEQUENCING VALVE MECHANISM

[75] Inventor: Thomas A. Mummert, Toledo, Ohio

[73] Assignee: Jobst Institute, Inc., Toledo, Ohio

[21] Appl. No.: 724,935

[22] Filed: Apr. 19, 1985

Related U.S. Application Data

[63] Continuation of Ser. No. 296,988, Aug. 27, 1981, abandoned.

[51] Int. Cl.[4] ..... F15B 21/02

[52] U.S. Cl. ..... 91/37; 91/40; 91/429; 137/624.14

[58] Field of Search ..... 91/36, 37, 40, 429; 137/624.14, 624.18, 625.66

[56] References Cited

U.S. PATENT DOCUMENTS

| | | | |
|---|---|---|---|
| 3,324,770 | 6/1967 | Dahlman et al. | 91/40 |
| 3,779,069 | 12/1973 | Berthold | 137/624.14 |
| 3,872,876 | 3/1975 | Bachman | 91/40 |
| 3,971,398 | 7/1976 | Taylor et al. | 137/624.14 |
| 3,993,098 | 11/1976 | Meynig | 91/350 |
| 4,251,898 | 2/1981 | Reichard | 91/40 |
| 4,367,763 | 1/1983 | Brand | 137/624.18 |

*Primary Examiner*—Robert E. Garrett
*Assistant Examiner*—Richard S. Meyer
*Attorney, Agent, or Firm*—Fraser and Clemens

[57] ABSTRACT

A sequencing valve mechanism utilized to control a pneumatic or hydraulic pressure medium from an on/-off type pressure source to a two-chambered pneumatic or hydraulic appliance is disclosed. A pawl on a ratchet arm is driven around a ratchet island by the alternate application and withdrawal of pressure to the sequencing device. The ratchet arm is pivotally attached to a valve control arm which regulates a valve so as to control the output of a pressure source. The shapes of the ratchet island portions are such that two alternate applications and withdrawals of pressure are required for the pawl to complete one cycle about the island and, thereby, actuate the valve to different output positions only on alternate applications of pressure to the sequencing device.

15 Claims, 7 Drawing Figures

SEQUENCING VALVE MECHANISM

This application is a continuation of Ser. No. 296,988 filed Aug. 27, 1981 and now abandoned.

BACKGROUND OF THE INVENTION

1. Field of the Invention

The present invention relates in general to mechanical valve systems and in particular to a sequencing valve mechanism for controlling the application of pressure from a pulsating source of pressure to a pair of output appliances.

2. Description of the Prior Art

In a pneumatic or hydraulic control system, pressure is supplied from a source to operate one or more output appliances. Generally, it is desirable to regulate the application of such pressure according to a predetermined sequence. A common mechanism for regulating a pneumatic control system utilizes a valve actuating means which is responsive to the application of pressure thereto. For example, U.S. Pat. No. 3,134,304 to Hager discloses a pressure operated pump utilizing a lever acutated by a compressor or pump shaft to work a spring to an over-center position, whereupon spring forces throw the lever completely over to operate a movable valve which is adapted to be controlled by the lever. U.S. Pat. No. 3,955,431 to Davis et al. discloses a valve actuator toggle mechanism for opening and closing a rotary valve by pushing a push rod.

Other mechanisms employ cam or stop means to regulate the operation of a pneumatic control means. U.S. Pat. No. 3,078,500 to Millard et al. discloses an automatic door closer and check mechanism including a generally triangularly-shaped cam opening for guiding a cam plate to define the opening and closing motions. U.S. Pat. No. 3,334,521 to Kast discloses a control mechanism which allows an actuator to move a load from one of a plurality of pre-selected stop positions to another such stop position, yet prevents the load forces acting upon the mechanism from actuating the mechanism away from a pre-selected stop position.

SUMMARY OF THE INVENTION

The present invention relates to a sequencing valve mechanism which is utilized to control a pneumatic or hydraulic pressure medium from an on-off type pressure source to a two-chambered pneumatic or hydraulic appliance or device. A pawl on a ratchet arm is driven around a ratchet island by the alternate application and withdrawal of pressure to the sequencing device. The ratchet arm is pivotally attached to a valve control arm. The valve control arm includes valve plunger actuation pads which regulate a valve so as to selectively direct the output of the pressure source alternately to the two chambers.

The ratchet island is formed with upper and lower portions separated by a channel. The shapes of the ratchet island portions are such that two alternate applications and withdrawals of pressure to the appliance are required for the pawl to complete one cycle about the island and the valve control arm is moved to actuate the valve to different output positions only on alternate applications of pressure to the sequencing device. Thus, the valve will be actuated on every other application of pressure and, therefore, the pressure from the source will be applied alternately to the two chambers.

It is an object of the present invention to provide a sequencing valve mechanism for controlling a pneumatic or hydraulic pressure medium from an on-off pressure source to a two-chambered device.

It is another object of the present invention to provide a valve mechanism to direct the output of a pulsating pressure source alternately between two outputs.

It is a further object of the present invention to provide a valve actuating means which is responsive to the cyclic application of pressure to alternately apply the pressure to a pair of therapeutic devices.

Other objects and advantages of the present invention will become apparent to those skilled in the art from the following detailed description of the preferred embodiment of the invention, when read in light of the accompanying drawings.

DETAILED DESCRIPTION OF THE PREFERRED EMBODIMENT

Figure 1:
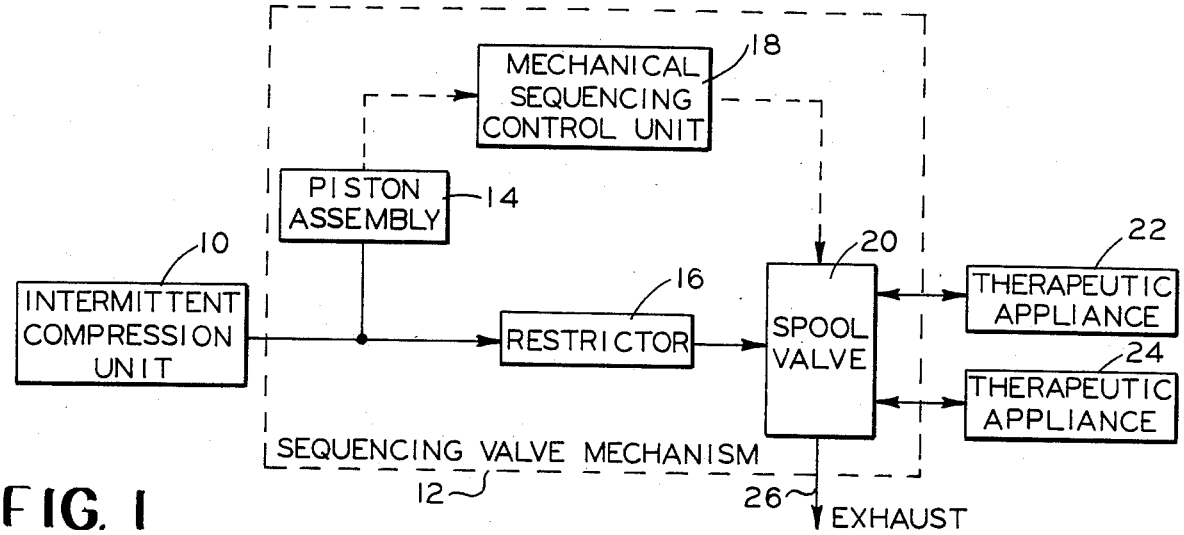
FIG. 1 is a block diagram of the therapeutic appliance control circuit utilizing a sequencing valve mechanism in accordance with the present invention.

Referring now to the drawings, there is illustrated in FIG. 1 a block diagram of a therapeutic appliance control circuit utilizing a sequencing valve mechanism in accordance with the present invention. A source of pressure, such as an intermittent compression unit 10, generates an on/off type pulsating flow of fluid or gas to a sequencing valve mechanism 12. As used herein, the intermittent compression unit 10 is "on" when it is applying pressure to the sequencing valve mechanism 12 and is "off" when it applies no such pressure. The output of the intermittent compression unit 10 is fed to a piston assembly 14. The piston assembly 14 is responsive to the application of pressure by the intermittent compression unit 10 for generating mechanical movement in one direction. As will be explained in greater detail below, a spring means causes the piston assembly 14 to move in an opposite direction when the compression unit 10 is off. The output of the compression unit 10 is also connected to a flow restrictor 16. The restrictor 16 is conventional in the art and regulates the pneumatic or hydraulic fluid flow therethrough to a predetermined maximum rate. The restrictor 16 causes the sequencing valve mechanism 12 to be actuated before the fluid flow is applied to an output device.

The piston assembly 14 is mechanically connected to a mechanical sequencing control unit 18. The control unit 18 mechanically operates a spool valve 20, which valve 20 regulates the flow of pressure from the flow restrictor 16 to one of two therapeutic appliances 22 and 24. The spool valve 20 is also connected to an exhaust line 26 for relieving the pressure in the therapeutic appliances 22 and 24. The appliances 22 and 24 can be utilized to apply compressive pressures to different portions of the body. As will be explained below, the mechanical sequencing control unit 18 operates the spool valve 20 such that pulses of pressure generated by the compression unit 10 are applied in alternating fashion to the therapeutic appliances 22 and 24. When pressure is applied to one therapeutic appliance 22, the other appliance 24 is connected to the exhaust line 26 to release any pressure retained therein and vice versa.

Figure 2:
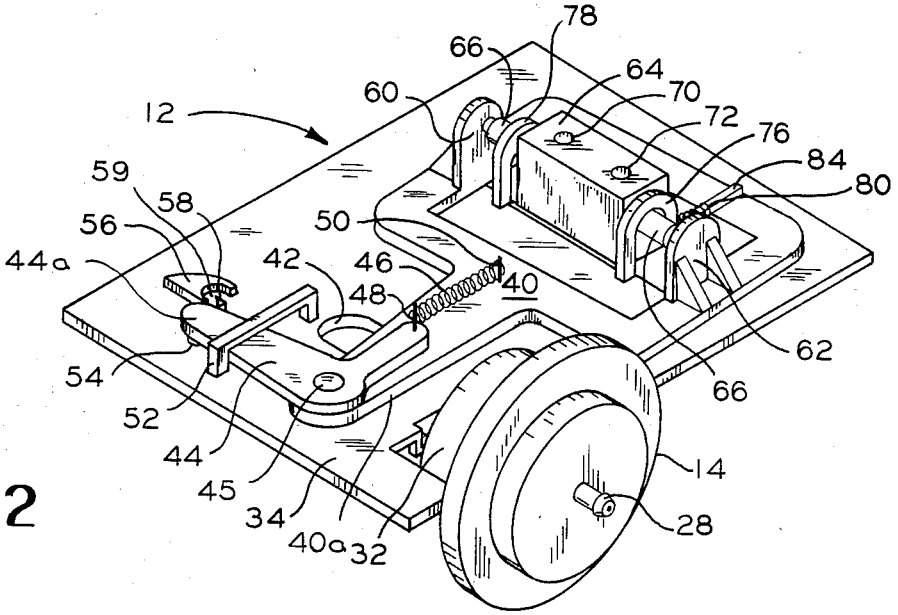
FIG. 2 is a perspective view of the top side of the sequencing valve mechanism of FIG. 1.
Figure 3:
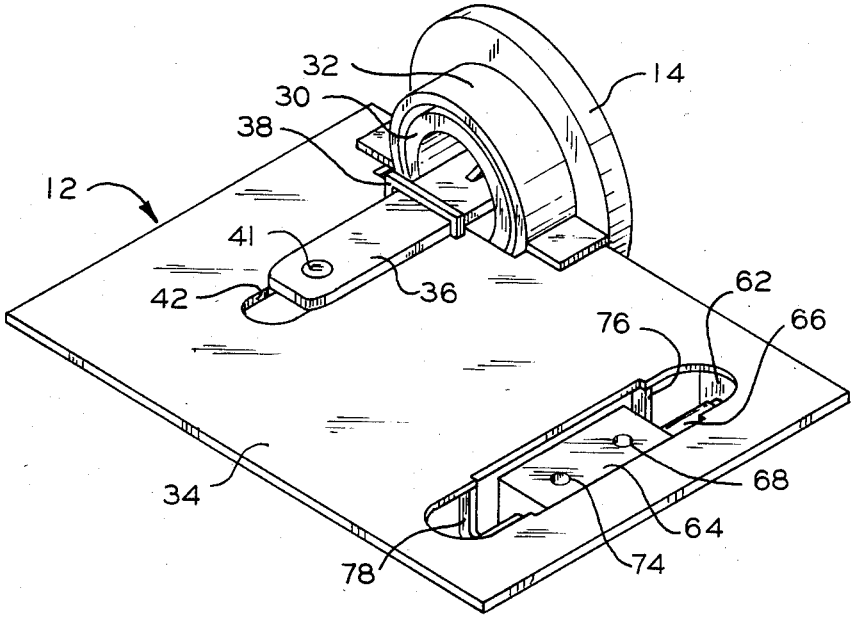
FIG. 3 is a perspective view of the bottom side of the sequencing valve mechanism of FIG. 1.

FIGS. 2 and 3 more clearly illustrate the construction of the sequencing valve mechanism 12. An inlet 28 connects the piston assembly 14 to the intermittent compression unit 10. The piston assembly 14 is conventional in the art and includes a piston 30 which is slidably disposed within a cylinder 32. A rolling cup diaphragm (not shown) provides an air-tight seal between the piston 30 and the cylinder 32. The cylinder 32 is cup-shaped with the inlet 28 formed in the closed end thereof. When pressure is applied by the compression unit 10 through the inlet 28 to the interior of the cylinder 32, the piston 30 is pushed outwardly from the open end of the cylinder 32.

The piston assembly 14 is secured to a base plate 34 of the sequencing valve mechanism 12. A flat connecting rod 36 is attached to the piston 30 and extends from the open end of the cylinder 32 through a guide 38 attached to the bottom side of the base plate 34. The guide 38 allows the connecting rod 36 to slide longitudinally therethrough as the piston 30 moves through the cylinder 32. A generally planar valve control member 40 having a generally O-shaped portion with an arm 40*a* extending from a central portion of one longitudinal side thereof is pivotally secured to the top side of the base plate 34 at a point along the other longitudinal side of the O-shaped portion. The connecting rod 36 is pivotally secured to the extending arm 40*a* of the valve control member 40 by a pin 41 extending through an oval-shaped aperture 42 formed in the base plate 34. It will be appreciated that the movement of the piston 30 will impart motion through the connecting rod 36 to the valve control member 40, causing the member 40 to swing about the point at which it is pivotally secured to the base plate 34. The length of the slot 42 will determine the angular extent of the movement of the member 40.

An L-shaped ratchet arm 44 is pivotally secured to the valve control arm 40 by a pin 45. One end of the ratchet arm 44 is attached to the valve control member 40 by a spring 46. The spring 46 extends between an upstanding post 48 attached to the ratchet arm 44 and a corresponding post 50 attached to the valve control member 40. Thus, although the ratchet arm 44 can pivot with respect to the valve control member 40, the spring 46 will tend to return the ratchet arm 44 to a single equilibrium position with respect to the member 40. The other end of the ratchet arm 44 extends through a guide 52 attached to the top side of the base plate 34. The tip 44*a* of the other end of the ratchet arm 44 has a downwardly depending pawl 54 attached thereto. A pair of ratchet island portions 56 and 58 are attached to the base plate 34, rising upwardly therefrom and forming a channel 59 therebetween. As will be explained in detail below, the pawl 54 on the ratchet arm 44 cooperates with the ratchet island portions 56 and 58 so as to regulate the movement of the valve control member 40 according to a predetermined sequence.

As mentioned above, the valve control member 40 is pivotally secured to the top side of the base plate 34 at a point along one longitudinal side of the O-shaped portion of the member 40. A pair of upstanding valve actuation members 60 and 62 are attached at opposing ends of the O-shaped portion of the valve control member 40. The spool valve 20 includes a spool valve body 64 which is disposed between the valve actuation members 60 and 62. The spool valve body 64 is conventional in the art and includes a plunger 66 which extends longitudinally therethrough. The plunger 66 is capable of limited sliding motion through the body of the spool valve 64 such that pressure supplied to an input port 68 of the valve body 64 is directed to one of two output ports 70 and 72. The spool valve body 64 also includes an exhaust port 74. When pressure is supplied from the input port 68 to one output port 70, the other output port 72 is connected to the exhaust port 74 to vent any pressure therefrom. Similarly, when the input port 68 is connected to the other output port 72, the one output port 70 is connected to the exhaust port 74 to vent the pressure therefrom.

The spool valve body 64 is attached to the base plate 34 by a pair of upstanding valve mounting tabs 76 and 78. The plunger 66, however, extends beyond the body of the spool valve 64 and through suitable apertures formed in the valve mounting tabs 76 and 78 into engagement with the valve actuation members 60 and 62. Thus, the body of the spool valve 64 is fixed in position relative to the base plate 34 while the plunger 66, actuated by the valve actuation members 60 and 62 attached to the O-shaped portion of the valve control member 40, is movable relative to the base plate 34. The output ports 68 and 70 are respectively connected to the therapeutic appliances 22 and 24 by flexible tubes (not shown) or other suitable means.

Figure 4A:
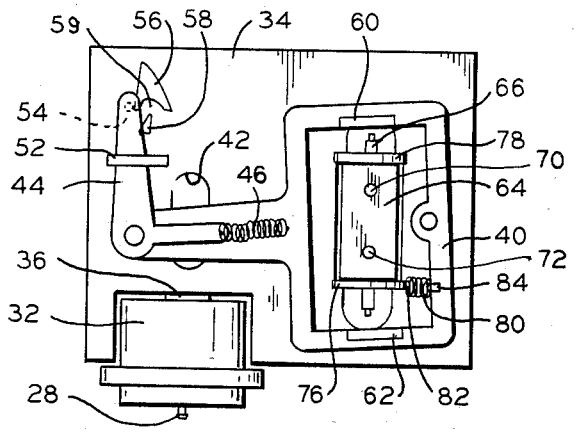
FIG. 4A through 4D are top plan views illustrating the operation of the sequencing valve mechanism of FIGS. 2 and 3.

FIGS. 4A through 4D illustrate in sequence the operation of the sequencing valve mechanism 12. In FIG. 4A, the intermittent compression unit 10 is off and, therefore, no pressure is applied to the piston assembly 14 or the flow restrictor 16 of the sequencing valve mechanism 12. The pawl 54 is positioned adjacent a lower end of the left side of the island portion 56. A spring 80 extends between a first boss 82 formed on the base plate 34 and a second boss 84 formed on the O-shaped portion of the valve control member 40. The spring 80 applies a tension to the pivotable valve control member 40, tending to rotate the member 40 in a direction opposite to the direction of rotation caused by the movement of the piston 30 in response to the application of pressure by the intermittent compression unit 10. Thus, it can be seen that when pressure is applied to the piston assembly 14 at the inlet 28, the valve control member 40 will rotate in a direction away from the cylinder 32 in response to the movement of the piston 30. When the applied pressure is removed from the piston assembly 14, the spring 80 will move the valve control member 40 and the piston 30 back to their original positions.

The valve actuation members 60 and 62 initially position the plunger 66 of the spool valve 64 such that the inlet port 68 is connected to the output port 70. However, since no pressure is being applied by the intermittent compression unit 10, the therapeutic appliance 22 connected to the output port 70 is not inflated. At the same time, the other output port 72 is connected to the exhaust port 74 so that any pressure contained within the other therapeutic appliance 24 will be vented to the atmosphere.

Figure 4B:
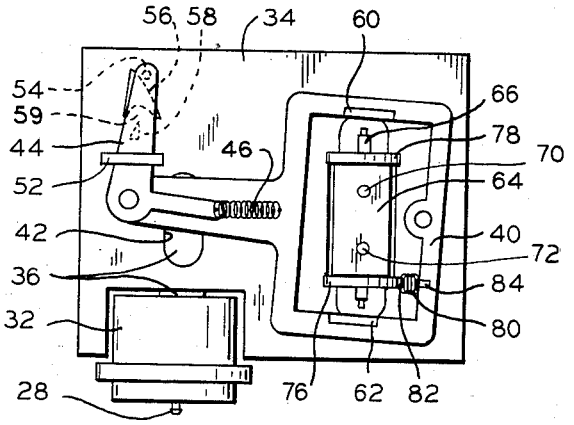

FIG. 4B illustrates the position of the components of the sequencing valve mechanism 12 after the intermittent compression unit 10 has been turned on. When the compression unit 10 is first turned on, the pressure applied to the piston assembly 14 causes the piston 30 and the connecting rod 36 to move outwardly away from the cylinder 32. The movement of the connecting rod 36 causes the valve control member 40 to pivot with respect to the base plate 34 when the opposing force exerted by the spring 80 is overcome. At the same time, the ratchet arm 44 carried by the valve control member 40 will move upwardly. However, soon after beginning such upward movement, the pawl 54 on the ratchet arm 44 will engage the left side of the ratchet island portion 56 and slide upwardly along that side. Since the ratchet arm 44 is pivotally attached to the valve control member 40, the upward movement of the valve control member 40 and the ratchet arm 44 is not prevented. However, the spring 46 attached to the valve control member 40 applies a force to the one end of the ratchet arm 44, tending to rotate it back to the equilibrium position with respect to the valve control member 40.

The pivoting movement of the valve control member 40 causes the valve actuation members 60 and 62 to move the plunger 66 through the spool valve 64. The movement of the plunger 66 causes the input port 68 to be connected to the other output port 72 and the output port 70 to be connected to the exhaust port 74. Since the intermittent compression unit 10 is on, the therapeutic appliance 24 connected to the output port 72 will be inflated. The therapeutic appliance 22 connected to the output port 70 will be vented to the atmosphere through the exhaust port 74.

The pivoting movement of the valve control member 40 also causes the pawl 54 to travel upwardly past the upper end of the ratchet island portion 56. When the pawl 54 has cleared the end of the ratchet island portion 56, the spring 46 will cause the ratchet arm 44 to pivot back toward the equilibrium position with respect to the valve control member 40. Such pivoting moves the pawl 54 from the left side of the ratchet island portion 56 to the right side, as illustrated in FIG. 4B. The components of the sequencing valve mechanism 12 will remain in this configuration until the intermittent compression unit 10 is turned off.

Figure 4C:
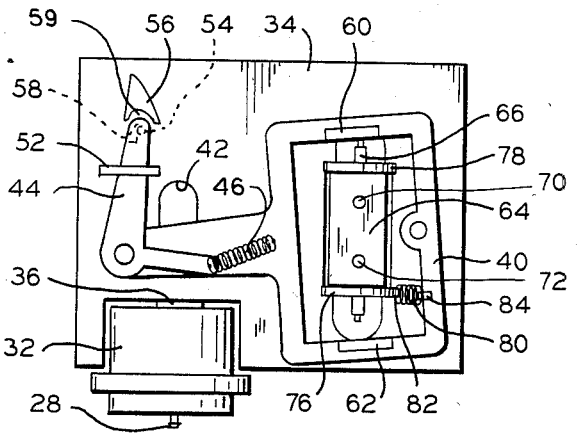

FIG. 4C illustrates the position of the components of the sequencing valve mechanism 12 after the intermittent compression unit 10 has been turned off to remove the fluid pressure from the cylinder 32. The spring 80 causes the valve control member 40, the connecting rod 36, and the piston 30 to move inwardly toward their original positions. Similarly, the plunger 66 is moved by the valve actuation members 60 and 62 to its previous position. Thus, the input port 68 is connected to the output port 70 while the other output port 72 is connected to the exhaust port 74. Since the intermittent compression unit 10 is off, the therapeutic appliance 22 connected to the output port 70 will not be inflated. However, the therapeutic appliance 24 will be vented to the atmosphere through the exhaust port 74.

The return movement of the valve control member 40 causes the ratchet arm 44 to move downwardly. However, soon after beginning such downward movement, the pawl 54 on the ratchet arm 44 will engage the right side of the ratchet island portion 56 and slide downwardly along the other side. Since the ratchet arm 44 is pivotally attached to the valve control member 40, the general downward movement of the valve control member 40 and the ratchet arm 44 is not prevented. However, the spring 46 attached to the valve control member 40 applies a force to the one end of the ratchet arm 44, tending to rotate it back to the equilibrium position with respect to the valve control member 40. When the pawl 54 has traveled downwardly past the lower right end of the ratchet island portion 56, the spring 46 will cause the ratchet arm 44 to pivot back to the equilibrium position with respect to the valve control member 40. Such pivoting causes the pawl 54 to move from the right side of the ratchet island portion 56 into the channel 59 toward its original position, as illustrated in FIG. 4A. However, the other ratchet island portion 58 is engaged by the pawl 54 which prevents the pawl 54 from moving back to its original position, as illustrated in FIG. 4C. The pawl 54 engages the right side of the other ratchet island portion 58 and remains there until the intermittent compression unit 10 is turned on for a second time.

Figure 4D:
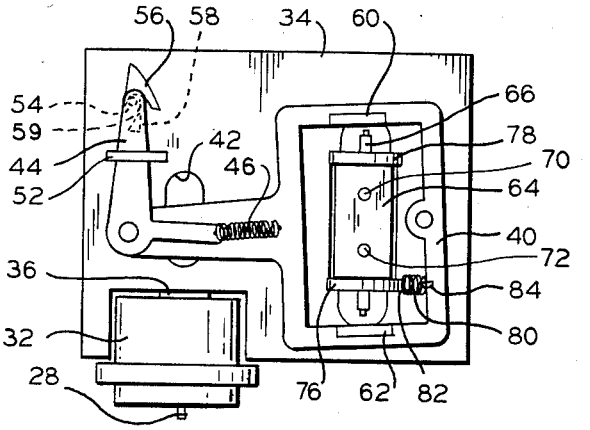

FIG. 4D illustrates the position of the components of the sequencing valve mechanism 12 after the intermittent compression unit 10 has been turned on for a second time. The pressure applied to the piston assembly 14 by the compression unit 10 causes the piston 30 and the connecting rod 36 to move outwardly from the piston assembly 14. The movement of the connecting rod 36 causes the valve control member 40 to begin to pivot with respect to the base plate 34. The ratchet arm 44 carried by the valve control member 40 will also pivot upwardly. However, shortly after beginning such upward movement, the pawl 54 will disengage from the island portion 58 and move across the channel 59 to engage a recessed bottom side of the ratchet island portion 56, thereby preventing any further upward movement of the valve control member 40. This limited movement of the valve control member 40 is not enough for the member 62 to contact the plunger 66 of the spool valve 64 and switch the connections of the ports as described above. Since the intermittent compression unit 10 is on, pressure supplied to the input port 68 will be provided through the output port 70 to the therapeutic appliance 22. The therapeutic appliance 24 connected to the other output port 72 will be vented to the atmosphere through the exhaust port 74.

When the intermittent compression unit 10 is again turned off, the spring 80 will cause the valve control member 40, the connecting rod 36, and the piston 30 to move back to the position illustrated in FIG. 4A. The sequencing valve mechanism 12 thus requires two alternate applications of pressure to complete one cycle. It will be appreciated that the spool valve 64 normally connects the intermittent compression unit 10 to one of the therapeutic appliances. The sequencing valve mechanism 12 is responsive to the application of pulses of pressure to connect the compression unit 10 to the other one of the therapeutic appliances during alternate pulses. Although the present invention has been disclosed as a device to interface between an intermittent compression unit and a therapeutic appliance, its use is not limited to such an application. The mechanical valve sequencing device according to the present invention can be utilized to control a pneumatic or hydraulic pressure medium from an on-off pressure source to a multi-chambered pneumatic or hydraulic appliance or device.

In accordance with the provisions of the patent statutes, the principle and mode of operation of the present invention have been explained and illustrated in its preferred embodiment. However, it must be understood that the invention can be practiced otherwise than as specifically described and illustrated without departing from its spirit or scope.

What is claimed is:

1. In an apparatus for applying intermittent pressure to a human limb including a source of a series of fluid pressure pulses and a pair of appliances responsive to the pulses for applying the pressure, a valve mechanism comprising:

piston means connected to the source of pulses and responsive to the application of the pulses for moving in one direction and responsive to the absence of the pulses for moving in the opposite direction;

valve means connected between the source of pulses and the appliances, said valve means having a first non-actuated position connecting one of the appliances to the source of pulses and the other one of the appliances to an exhaust port, and a second position connecting the one of the appliances to an exhaust port and the other one of the appliances to the source of pulses; and sequencing means connected between said piston means and said valve means for actuating said valve means to said second position in response to alternate ones of the pulses supplied to said piston means, said sequencing means including a connecting rod attached to said piston means and a valve control member connected between said connecting rod and said valve means, said valve means including a spool valve having a plunger slidably received in a body, said plunger being actuated by said valve control member, said valve control member including a pair of actuation members for alternately engaging opposite ends of said plunger.

2. A valve mechanism according to claim 1 wherein said spool valve has an inlet port connected to the source of pulses, a pair of outlet ports each connected to one of the appliances and an exhaust port open to the atmosphere.

3. A valve mechanism according to claim 1 wherein said plunger is actuated by said sequencing means between said first and second positions.

4. A valve mechanism according to claim 1 wherein said pair of valve actuation members are attached to opposing ends of a generally O-shaped portion for alternately engaging opposite ends of said plunger.

5. A valve mechanism according to claim 4 wherein said valve control member is pivotally mounted with respect said valve plunger.

6. A valve mechanism according to claim 1 wherein said sequencing means includes a ratchet arm pivotally mounted thereon and means for defining a path of movement for said ratchet arm whereby said ratchet arm and said means for defining a path cooperate to convert movements of said piston means in said one direction to alternate actuating of said valve means to said second position.

7. A valve mechanism according to claim 6 wherein said means for defining a path includes upper and lower ratchet islands defining a channel therebetween.

8. A valve mechanism according to claim 7 wherein said ratchet arm includes a pawl for engaging the edges of said islands to define said path.

9. A valve mechanism according to claim 8 wherein each of said ratchet islands is generally triangular in shape.

10. A sequencing valve mechanism for regulating the application of pressure from a source of pulses of pressure fluid to a pair of fluid actuated appliances comprising:

piston means responsive to the application of pressure fluid by a source for generating mechanical movement;

valve means for connecting the source to a pair of appliances, said valve means being normally connected to one of the appliances; and valve control means responsive to the movement of said piston means for actuating said valve means whereby the source is connected to the other one of the appliances during alternate pulses of pressure fluid from the source said valve control means including a member, said member having a valve actuation portion in contact with said valve means and an extending arm connected to said piston means for actuating said valve means in response to the movement of said piston means, and ratchet means attached to said member for controlling movement of said piston means such that the source is connected to the other one of the appliances during alternate pulses of pressure from the source.

11. A sequencing valve mechanism in accordance with claim 10 wherein said valve means includes a spool valve for connecting the source to the pair of appliances.

12. A sequencing valve mechanism in accordance with claim 11 wherein said valve means further includes spring means for urging said spool valve to normally connect the source to said one of the pair of appliances.

13. A sequencing valve mechanism for regulating the application of pressure from a pulsating source of pressure to first and second output appliances and to exhaust pressure from the first and second output appliances through an exhaust line comprising:

a base plate;

piston means attached to said base plate and responsive to the application of pressure by a source for generating mechanical movement;

valve means attached to said base plate including an input port connected to the source, an exhaust port connected to an exhaust line, first and second output ports connected to a first and a second output appliance respectfully, and plunger means movable between a first position, wherein said input and exhaust ports are connected to said first and second output ports, respectively, and a second position, wherein said input and exhaust ports are connected to said second and first output ports, respectively;

spring means for urging said plunger means normally towards said first position; and valve control means pivotally secured to said base plate and responsive to the movement of said piston means for moving said plunger means from said first position to said second position during alternate pulses of pressure from the source, said valve control means including a member, said member having a valve actuation portion in contact with said valve means and an extending arm connected to said piston means for regulating said valve means in accordance with the movement of said piston means, and ratchet means attached to said member for allowing such movement of said plunger means from said first position to said second position only during alternate applications of pressure by the source.

14. A sequencing valve mechanism in accordance with claim 13 wherein said ratchet means includes a ratchet arm pivotally attached to said member and having a pawl extending therefrom and a plurality of ratchet islands attached to said base plate for cooperation with said pawl, whereby the movement of said pawl about said ratchet islands allows movement of said piston means only during alternate applications.

15. A sequencing valve mechanism in accordance with claim 14 further including spring means attached to said ratchet arm and said member for biasing said ratchet arm in an equilibrium position with respect to said member.

* * * * *